US006676730B2

(12) United States Patent
Kim et al.

(10) Patent No.: US 6,676,730 B2
(45) Date of Patent: Jan. 13, 2004

(54) METHOD OF PRODUCING ND-FE-B BASED NANOPHASE POWER

(75) Inventors: Byung Kee Kim, Changwon (KR); Chul Jin Choi, Changwon (KR); Xing Long Dong, Changwon (KR)

(73) Assignee: Korea Institute of Machinery and Materials, Kyungsangnamdo (KR)

( * ) Notice: Subject to any disclaimer, the term of this patent is extended or adjusted under 35 U.S.C. 154(b) by 0 days.

(21) Appl. No.: 09/863,640

(22) Filed: May 23, 2001

(65) Prior Publication Data

US 2002/0005088 A1 Jan. 17, 2002

(30) Foreign Application Priority Data

May 26, 2000 (KR) ..... 2000 28742

(51) Int. Cl.[7] ..... B22F 9/24
(52) U.S. Cl. ..... 75/349; 75/350; 148/105
(58) Field of Search ..... 75/348, 349, 350; 148/105, 302

(56) References Cited

U.S. PATENT DOCUMENTS 4,917,724 A * 4/1990 Sharma ..... 75/350
5,064,465 A * 11/1991 Chen et al. ..... 75/349
6,051,047 A * 4/2000 Zhou et al. ..... 75/349
6,221,270 B1 * 4/2001 Saito et al. ..... 252/62.55

* cited by examiner

*Primary Examiner*—George Wyszomierski
(74) *Attorney, Agent, or Firm*—Thompson Coburn LLP

(57) ABSTRACT

The present invention relates to a method of producing Nd—Fe—B based nanophase powder, or more particularly, to a method of producing $Nd_2Fe_{14}B$ phase powder of 1 $\mu$m or less, having $Nd_2Fe_{14}B$ crystal grains of 50 nm or less, which comprises the following steps of: producing a precursor powder having a mixture of elements of Nd, Fe and B by means of spray-drying a mixed aqueous solution comprising Nd metal salt, Fe metal salt, and boric acid; producing an oxide composite powder by means of desaltation of said powder; reducing the composite oxide powder, and ball-milling of said composite powder comprising Nd oxides and $\alpha$-Fe; producing a mixed powder of $Nd_2Fe_{14}B$/CaO phase by mixing Ca to said composite powder after milling; and removing CaO by washing said composite powder with water, followed by drying.

6 Claims, 4 Drawing Sheets

METHOD OF PRODUCING ND-FE-B BASED NANOPHASE POWER

TECHNICAL FIELD

The present invention relates to a method of producing Nd—Fe—B based nanophase powder, or more particularly, to a method of producing $Nd_2Fe_{14}B$ phase powder of 1 $\mu$m or less, comprising $Nd_2Fe_{14}B$ crystal grains of 50 nm or less, by means of a mechano-chemical process.

BACKGROUND OF THE INVENTION

In general, a permanent magnet is a material maintaining a magnetic field within the material in itself even after the removal of the externally-applied magnetic field. As such, it is necessarily used in motors, generators, electronic equipment, etc.

In particular, permanent magnets are utilized in high value-added products such as video recorders, computer disk drives, and electric motors, which are applicable in a variety of industries, and these magnets have a decisive effect on the quality and performance of the final product.

For the alloys of the conventional permanent magnets, the alnico and ferrite have been mainly used. However, with the trend towards compactness and high-performance of electronic, communications, and mechanical components, Nd—Fe—B based materials which have superior magnetic characteristics have been extensively used in recent years.

Nd—Fe—B based magnets are classified into sintered magnets which were developed in Japan, and the bond magnets which were developed in the United States. With respect to the method of producing sintered magnets, an alloy in the form of ingots is first prepared by means of casting, followed by powder making process with a sequential crushing and pulverization of the ingots.

Then, a magnet in form is produced by molding the alloy powder in the magnetic field, followed by sintering and heat-treatment. Consequently, in order to produce the magnet, powder making process of the Nd—Fe—B based alloy is necessary. The rapid cooling-solidification method which is used in the powder production method developed in the United States does have an advantage of producing materials of fine crystal grains. However, it has a disadvantage of deteriorating purity by being easily contaminated during the ribbon production and milling process. Further, there is a difficulty in general powder molding, which leads to necessitating molding with mixing of bonding agents, or molding by hot pressing.

Moreover, the ingot-crushing method, which is the powder production method developed in Japan, is a long and complicated process, in which the fine powder can be obtained is possible only after the numerous steps after the production of ingots. In addition, this process is long and has a limitation to obtain fine grain sized powder by pulverization.

SUMMARY OF THE INVENTION

Accordingly, in solving the aforementioned problems, the technical objective of the present invention lies in providing a method of producing nanophase powder without the mechanical crushing and pulverization process.

In achieving the aforementioned technical objectives, the present invention comprises the following steps of:

(a) Producing a Nd—Fe—B composite oxide powder;

(b) Producing a composite powder of Nd oxides and $\alpha$-Fe by means of reducing said Nd—Fe—B composite powder;

(c) Ball-milling said composite powder of Nd oxides and $\alpha$-Fe into fine particles;

(d) Forming $Nd_2Fe_{14}B$ and CaO by means of molding with a mixture of Ca powder and said composite powder particles, and then reducing the Nd oxides therein by heat-treatment in argon atmosphere; and (e) Producing the powder of a single phase of $Nd_2Fe_{14}B$ by means of removing the CaO by-products by washing with water, followed by drying.

DETAILED DESCRIPTION OF THE PREFERRED EMBODIMENT

Figure 1:
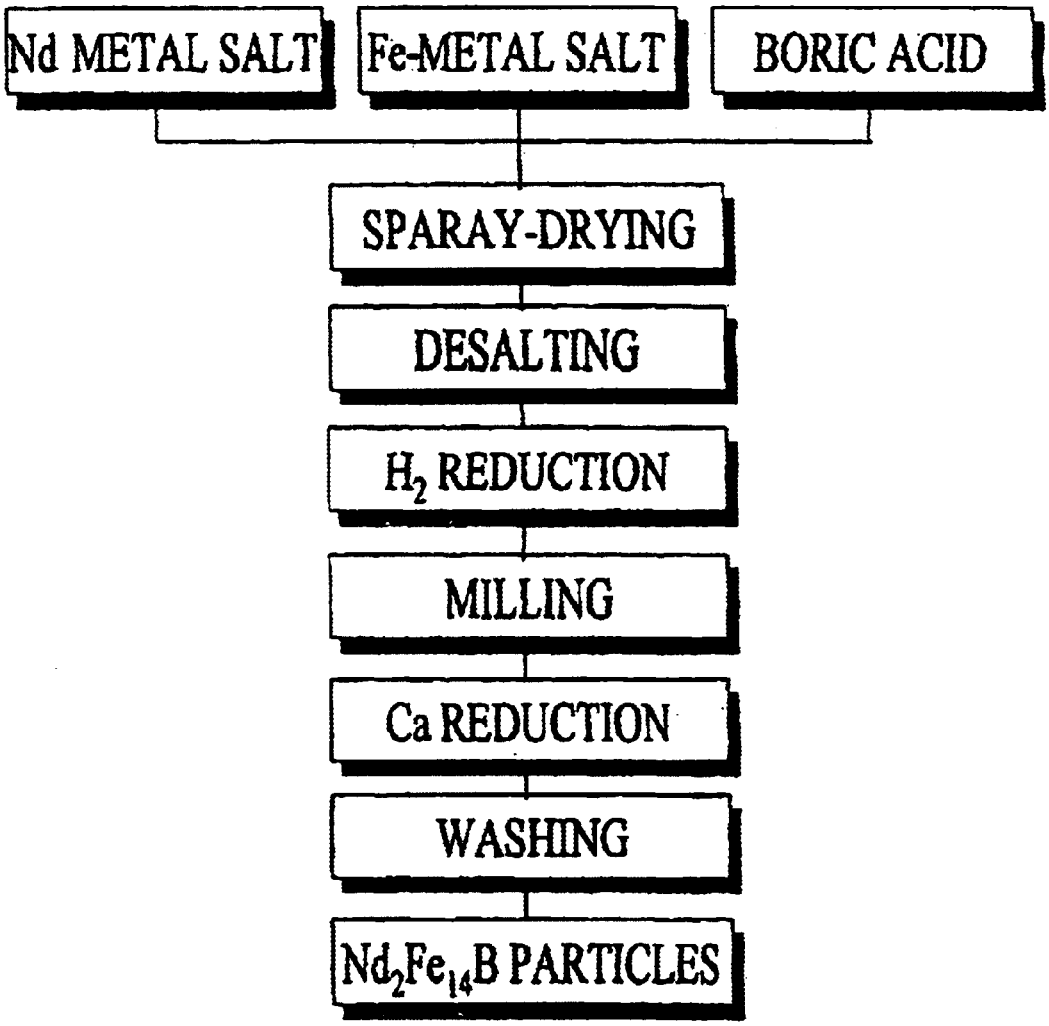
FIG. 1 is a process chart for producing the powder of the present invention.

In describing in more detail, the present invention comprises the following steps of:

(a) Preparing a mixed aqueous solution comprising Nd metal salt, Fe metal salt, and boric acid, to the target composition of 16~36 wt % of Nd, and 64~84 wt % of Fe—B;

(b) Producing a precursor powder by spray-drying said mixed aqueous solution in a vessel at 150~250° C. by using a nozzle of high-speed rotation at a speed of 5~15 ml/min (rotation speed of 8,000~15,000 rpm);

(c) Producing a Nd—Fe—B composite oxide powder by means of desaltation by heating said precursor powder in air at 750~1,000° C.;

(d) Producing a composite powder comprising Nd oxides and $\alpha$-Fe by means of reducing the composite oxide powder in a hydrogen atmosphere at 600~1,000° C.

(e) Ball-milling said composite powder into fine size of the precursor nanophase powder;

(f) Compacting with a mixture of said powder of grains and Ca powder (1.5 times of the stoichiometry ratio necessary for reducing the Nd oxides); and (g) Producing the powder of a single phase of $Nd_2Fe_{14}B$ by means of reducing the Nd oxides by heating said molding after mixing the Ca powder thereto in an argon atmosphere at 1,000° C. for 3 hours, and then removing the CaO byproducts by washing the same with water.

The present invention is described in more detail with references to the preferred embodiment as follows: After preparing the mixed aqueous solution comprising Nd metal salt, Fe metal salt, and boric acid, to the target composition of 20 wt % of Nd and 80 wt % of Fe—B, the same aqueous solutions was sprayed therein by using a nozzle capable of high-speed rotation at a speed of 10 ml/min (10,000 rpm). The vessel receiving the sprayed solution was maintained at the temperature of 200° C., after which was dried, leading to the production of the amorphous precursor powder. Then, desaltation was carried out onto the precursor powder by means of heat-treatment in air at 800° C. for 2 hours, resulting in the production of Nd—Fe—B composite oxide powder.

By reducing said composite oxides in the hydrogen atmosphere at 800° C. for 3 hours, the composite powder comprising Nd oxides and α-Fe was prepared. The ball-milling was carried out onto the same powder for 40 hours, resulting in the finely crushed precursor powder.

A compact was formed using a mold while mixing said powder of fine grains with the Ca powder in the amount of 1.5 times of the stoichiometry ratio necessary to reduce the Nd oxides.

Then, the pure compound of $Nd_2Fe_{14}B$ phase was formed by reducing the Nd oxides by heat-treating said compact in the argon atmosphere at 1,000° C. for 3 hours. The powder having a single phase of $Nd_2Fe_{14}B$ was prepared by removing the CaO by-products by washing with water. Moreover, a scanning electron micrograph of the $Nd_2Fe_{14}B$ powder is shown in FIG. 3.

Figure 3:
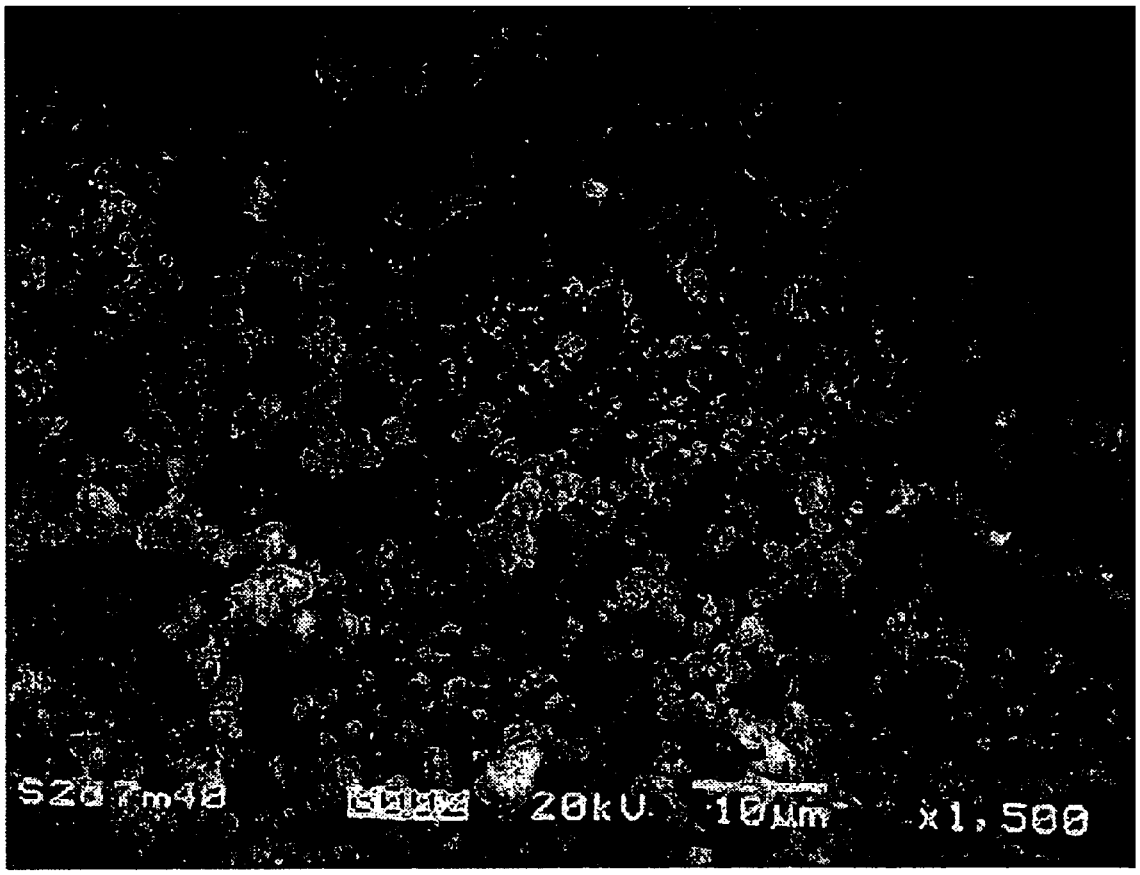
FIG. 3 is a scanning microscope photograph, showing the morphology of the powder of the present invention.
Figure 4:
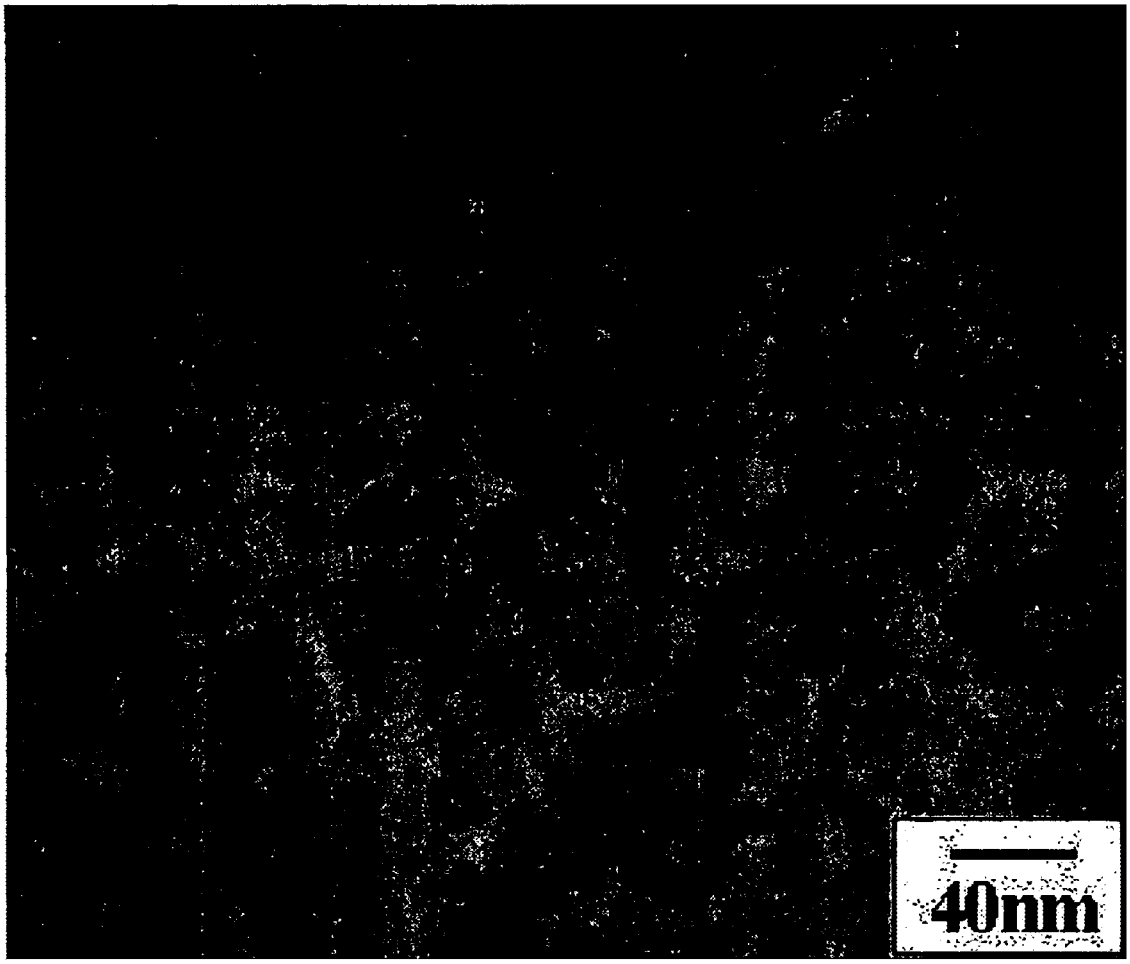
FIG. 4 is a photograph showing the grain size of the $Nd_2Fe_{14}B$ phase powder of the present invention.

FIG. 3 is a photograph of the $Nd_2Fe_{14}B$ phase powder, showing homogenous dispersion with the size of less than 1 μm Further, as for determining the size of the crystal grains, a transmission electron micrograph is shown in FIG. 4.

As shown in FIG. 4, the $Nd_2Fe_{14}B$ phase has a structure of extremely fine crystal grains less than 20 nm.

Figure 2:
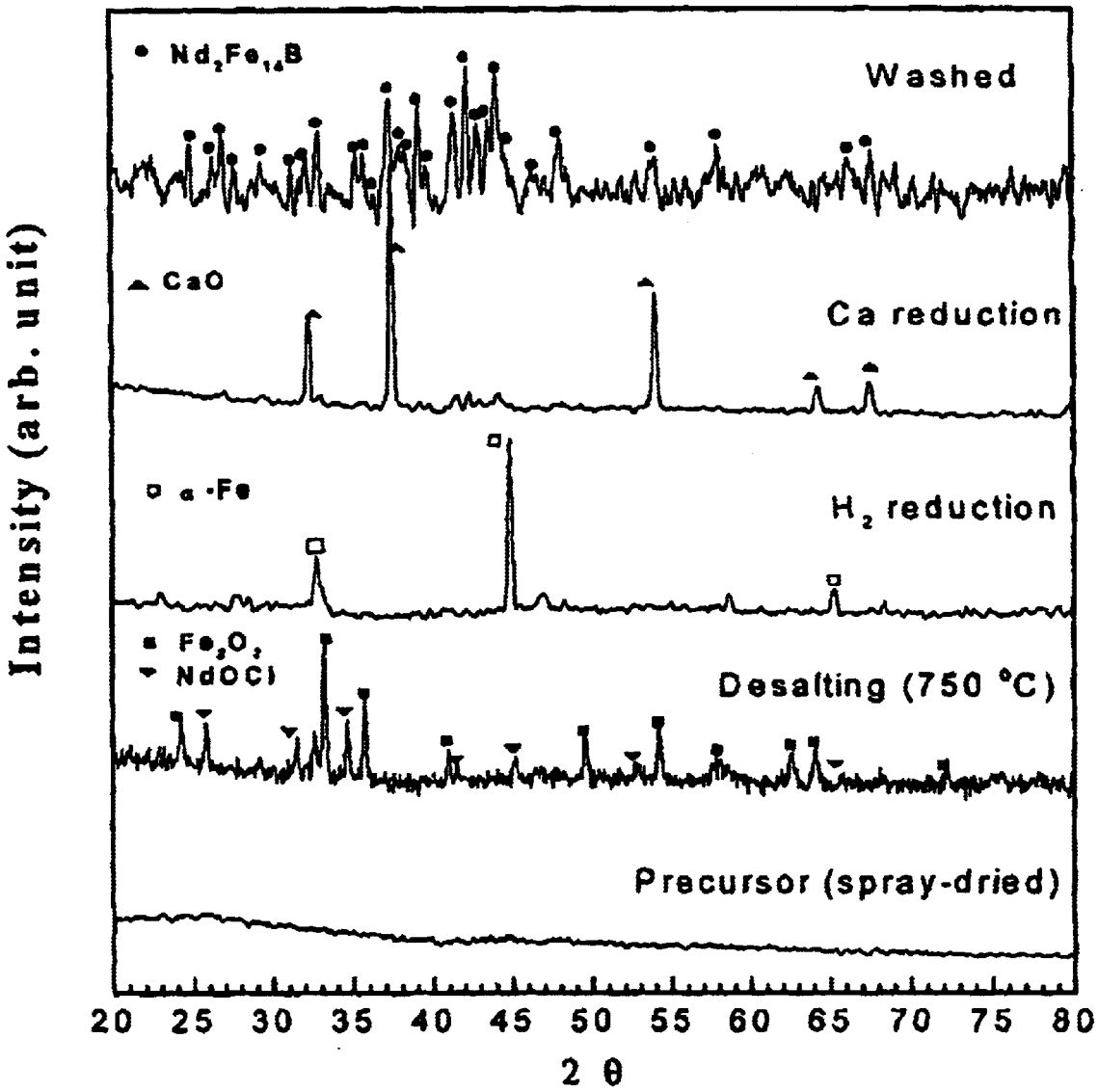
FIG. 2 is a set of the results of the X-ray diffraction, showing the phases of the powders as per respective production step of the present invention.

Further, FIG. 2 shows the results of the X-ray diffraction of the powders in the respective steps. As shown in FIG. 2, the precursor powder was amorphous while the powder after the desaltation step was of a crystal phase of Nd oxides and Fe oxides.

Consequently, the $Nd_2Fe_{14}B$ phase produced in the preferred embodiment comprises fine crystal grains of 50 nm or less, the powder of which is 1 μm or less.

The present invention has the effect of facilitating the production of pure nanophase powder by simplifying the process by dispensing with the mechanical crushing and pulverization process; preventing deterioration of purity, caused by the contamination during the crushing process; and solving the limitation as to the reduction of the grain size of the powder by pulverization.

What is claimed is:

1. A method of producing a Nd—Fe—B based nanophase powder comprising fine crystal grains of $Nd_2Fe_{14}B$ of 50 nm or less, with the size of the powder of 1 μm or less, wherein the steps of the method comprise:

(a) Producing a precursor powder having homogenous dispersion of Nd, Fe, and B by means of spray-drying a mixed aqueous solution comprising Nd metal salt, Fe metal salt, and boric acid;

(b) Producing a Nd—Fe—B composite oxide powder by means of desalting said precursor powder in air at 750 to 1,000° C;

(c) Producing a composite powder comprising Nd oxides and α-Fe by means of hydrogen reduction of said composite oxide powder at 600 to 1,000° C.;

(d) Ball-milling said composite powder into fine particles;

(e) Compacting a mixture of said fine particles with an addition of Ca, for reduction of the oxides therein, and producing a mixed powder of $Nd_2Fe_{14}B$/CaO phase by means of reducing the Nd oxides therein in an argon atmosphere; and (f) Removing CaO by washing said mixed powder with water, followed by drying.

2. A method of producing a Nd—Fe—B based nanophase powder according to claim 1, wherein said spray-drying of the mixed aqueous solution comprises spraying said mixed aqueous solution onto a vessel at 150 to 250° C. by using a nozzle of high-speed rotation of 8,000 to 15,000 rpm at a speed of 5 to 15 ml/min.

3. A method of producing a Nd—Fe—B based nanophase powder according to claim 1, wherein the Ca to be added therein is added in an amount which is 1.5 times of the stoichiometry ratio necessary for reducing the Nd oxides therein.

4. A method of producing a Nd—Fe—B based nanophase powder according to claim 1, wherein the Nd oxides in the fine particles are reduced in the argon atmosphere at 1,000° C.

5. A method of producing a Nd—Fe—B based nanophase powder according to claim 4, wherein said spray-drying of the mixed aqueous solution comprises spraying said mixed aqueous solution onto a vessel at 150 to 250° C. by using a nozzle of high-speed rotation of 8,000 to 15,000 rpm at a speed of 5 to 15 ml/min.

6. A method of producing a Nd—Fe—B based nanophase powder according to claim 4, wherein the Ca to be added therein is added in an amount which is 1.5 times of the stoichiometry ratio necessary for reducing the Nd oxides therein.

* * * * *